US009091029B2

(12) United States Patent
Roetsch

(10) Patent No.: US 9,091,029 B2
(45) Date of Patent: Jul. 28, 2015

(54) ROTOR HOUSING FOR A MILLING DEVICE FOR SOIL PROCESSING, MILLING DEVICE, AND METHOD FOR CLEANING A ROTOR HOUSING

(71) Applicant: BOMAG GmbH, Boppard (DE)

(72) Inventor: Helmut Roetsch, Beltheim (DE)

(73) Assignee: BOMAG GmbH, Boppard (DE)

( * ) Notice: Subject to any disclaimer, the term of this patent is extended or adjusted under 35 U.S.C. 154(b) by 422 days.

(21) Appl. No.: 13/644,299

(22) Filed: Oct. 4, 2012

(65) Prior Publication Data

US 2013/0087172 A1 Apr. 11, 2013

(30) Foreign Application Priority Data

Oct. 7, 2011 (DE) ..... 10 2011 115 325

(51) Int. Cl.
*E01C 19/45* (2006.01)
*E01C 23/088* (2006.01)
*E01C 21/00* (2006.01)

(52) U.S. Cl.
CPC ..... *E01C 23/088* (2013.01); *E01C 21/00* (2013.01); *E01C 19/45* (2013.01); *Y10T 74/2191* (2015.01)

(58) Field of Classification Search
CPC ..... E01C 19/45; E01C 21/00; E01C 23/088; Y10T 74/2191
USPC ..... 404/83, 92; 299/39.4; 405/128.15
See application file for complete search history.

(56) References Cited

U.S. PATENT DOCUMENTS

| | | | | |
|---|---|---|---|---|
| 4,637,753 | A * | 1/1987 | Swisher, Jr. | 404/90 |
| 5,354,147 | A * | 10/1994 | Swisher, Jr. | 299/39.6 |
| 5,893,677 | A * | 4/1999 | Haehn et al. | 404/90 |
| 6,149,342 | A | 11/2000 | Phillips | |
| 6,543,963 | B2 * | 4/2003 | Bruso | 405/128.15 |
| 6,887,013 | B2 * | 5/2005 | Ley et al. | 404/90 |
| 8,794,869 | B2 * | 8/2014 | Schlenker et al. | 404/92 |
| 8,939,515 | B2 * | 1/2015 | Franzmann et al. | 299/39.4 |
| 8,956,076 | B2 * | 2/2015 | Menzenbach et al. | 404/84.5 |
| 9,011,039 | B2 * | 4/2015 | Oxford et al. | 404/90 |
| 2011/0272997 | A1 | 11/2011 | Gaertner et al. | |
| 2012/0068524 | A1 * | 3/2012 | Hall et al. | 299/39.2 |

FOREIGN PATENT DOCUMENTS

DE 102 13 017 A1 10/2003

OTHER PUBLICATIONS

Espacenet.com, English Machine Generated Translation of German Application No. DE 102 13 017 A1, retrieved from http://worldwide.espacenet.com on Sep. 5, 2012 (8 pages).
German Patent Office, Search Report, German Application No. 10 2011 115 325.3, dated Jul. 2, 2012 (5 pages).

* cited by examiner

*Primary Examiner* — Raymond W Addie
(74) *Attorney, Agent, or Firm* — Wood, Herron & Evans, LLP

(57) ABSTRACT

The present invention relates to a rotor housing for a milling device for soil processing, in particular, for a road milling machine, a recycler, or a stabilizer, having a cleaning apparatus, with an interior open toward the ground for receiving a milling rotor, comprising two side walls, one front wall, and one rear wall, the side walls, the front wall, and the rear wall delimiting the interior to the outside, comprising an internally arranged cleaning strip. Furthermore, the present invention relates to a milling device with a rotor housing having such a cleaning apparatus and a method for cleaning a rotor housing.

17 Claims, 5 Drawing Sheets

ROTOR HOUSING FOR A MILLING DEVICE FOR SOIL PROCESSING, MILLING DEVICE, AND METHOD FOR CLEANING A ROTOR HOUSING

CROSS-REFERENCE TO RELATED APPLICATIONS

The present application claims priority under 35 U.S.C. §119 of German Patent Application No. 10 2011 115 325.3, filed Oct. 7, 2011, the disclosure of which is hereby incorporated herein by reference in its entirety.

FIELD OF THE INVENTION

The present invention relates to a rotor housing for a milling device for soil processing, in particular, for a road milling device, a recycler, or a stabilizer. The rotor housing has an interior, which is open toward the ground, for receiving a milling rotor, comprising two side walls, one front wall, and one rear wall, the side walls, the front wall, and the rear wall delimiting the interior of the rotor housing to the outside. Furthermore, the present invention relates to a milling device for soil processing, in particular, a road milling device, recycler, or stabilizer, having such a rotor housing, as well as a method for cleaning a rotor housing of soil material adhering in the interior of the rotor housing.

BACKGROUND OF THE INVENTION

Milling devices of the generic type are typically used in road and path construction. For example, road milling devices are specifically used for milling off an existing road surface in need of renewal, recyclers and stabilizers are used for crushing and/or mixing the soil material, for example, with binders. Such milling devices can be implemented as self-propelled machines or also as trailer elements, for example, for attachment to a tractor. The implement of such milling devices is a milling rotor, which is typically a hollow-cylindrical body, which is equipped on its outer side with milling tools as, for example, chisels. In working operation, the milling rotor, which has been lowered into the soil, rotates and mills off soil material, for example. For this purpose, the milling rotor is typically arranged on the milling device lying transversely to the travel direction of the milling device and rotates in or opposite to the working direction, depending on the mode of operation. The milling rotor is typically enclosed by the rotor housing, in order to be able to mix the milled material with a binder and/or prevent milled material from being thrown around and/or to allow a controlled material transport out of the milling area. The rotor housing is therefore an apparatus which encloses the milling rotor on top, to the sides, in the working direction and opposite thereto. The rotor housing is implemented as open toward the ground so that the milling rotor can come into engagement with the soil to be processed.

In working operation, adhesion of soil material and/or contaminants on the inner side of the rotor hood frequently occurs. This occurs, in particular, if the rotor hood additionally has a spraying device via which water and/or binder, for example, bitumen foam, are introduced into the interior of the rotor housing for mixing with the soil material. These contaminants and/or soil materials, which are also designated in general hereafter as adhesions, particularly frequently have the result that the nozzles of the spraying device clog, and reliable fluid and/or bitumen supply is no longer ensured. In addition, the mixing results can also be significantly influenced thereby.

Previously, it was typical to interrupt the milling work to clean the rotor housing and, for example, to remove the rotor from the rotor housing or to take down the rotor housing, which is implemented as a rotor hood, for example, in order to gain access to the interior of the rotor housing. The contaminants in the rotor space were then removed with the aid of cutters, pneumatic hammers, shovels, etc. Afterwards, the milling rotor was reintroduced into the rotor housing or the rotor hood was attached, respectively, and the milling work could be continued. This cleaning method is cumbersome and time-consuming and results in a comparatively long shutdown of the milling device.

Especially for embodiments of a milling device having a spraying device, providing a plunger arrangement in each nozzle for cleaning purposes of the spray nozzles is also known, as is specified, for example, in DE 102 41 067 B3. However, this solution only achieves sufficient cleaning results in the case of slight adhesions and is nearly ineffective in the case of extreme contamination. In addition, this arrangement is comparatively complicated and costly to produce and maintain, as a separate plunger arrangement is required for each nozzle, and it is also targeted solely to the cleaning of the nozzle opening per se.

SUMMARY OF THE INVENTION

The object of the present invention is to provide a concept for removing adhesions accumulated in the rotor housing as cost-effectively, reliably, and fast as possible.

One aspect of the present invention is that a cleaning apparatus, which is arranged in the interior of the rotor housing, is provided with a cleaning strip that is at least partially movable in relation to the rotor housing, the rotor housing also having at least one passage opening via which impacts and/or shaking movements can be applied to the cleaning strip from outside the rotor housing. Rotor housing in the present case means the apparatus by which an enclosure of the milling rotor is provided. The side walls are those enclosure parts of the rotor housing which are arranged on the end sides of the milling rotor, i.e., in front of and behind the milling rotor in the axial direction of the rotational axis of the milling rotor. The front wall is the part of the rotor housing which encloses the milling rotor in the working direction up to the height of the rotational axis in relation to the vertical plane along the rotational axis of the milling rotor. Accordingly, the rear wall is the part of the rotor housing which encloses the milling rotor opposite to the working direction from the rotational axis of the milling rotor or adjoins the front wall opposite to the working direction, respectively. The wall elements designated in the present case accordingly do not have to be made planar, but rather can also comprise, for example, three-dimensional deformations, for example, hood-like bulges, multiple wall segments attached to one another at an angle, etc. The important aspect in this regard is that the rotor housing in its entirety provides an at least nearly complete housing with an opening toward the ground for the milling rotor.

One element of the rotor housing according to the present invention is a cleaning apparatus. The cleaning apparatus is generally implemented in such a manner that adhesions (contaminants and/or soil material) accumulated in the interior of the housing can be removed. One element of the cleaning apparatus according to the present invention is a cleaning strip. The cleaning strip is arranged in the interior of the rotor housing and is at least partially movable in relation to the rotor housing. The cleaning strip can therefore be moved, for example, at least in a subregion relative to the wall elements of the rotor housing (side walls, front wall, and rear wall), this particularly also comprising bending movements of the cleaning strip in addition to pivoting, for example. Through this relative mobility of at least a subregion of the cleaning strip in relation to the wall elements of the rotor housing, for example, impact and/or vibration pulses can be exerted on the cleaning strip, which result in a relative movement such as, for example, a vibration movement, of at least a part of the cleaning strip in relation to the rotor housing. The adhesions, at least on the cleaning strip itself and in the regions of the rotor housing adjacent to the cleaning strip, are thus loosened and finally fall off in the interior of the rotor housing.

One aspect of the present invention is that the rotor housing has at least one passage opening via which impacts and/or shaking movements can be applied to the cleaning strip from outside the rotor housing. The cleaning strip can therefore be excited into the relative movements such as, for example, bending movements, from outside the rotor housing, so that a complex disassembly of the rotor housing and/or a removal of the milling rotor are no longer required for cleaning purposes. In addition, the space requirement of the cleaning apparatus according to the present invention is extremely low, in particular, in relation to the interior of the rotor housing. The cleaning strip is preferably arranged pressing flatly against the inner surface of the rotor housing and vibrates or bends, respectively, upon the application of impacts and/or shaking movements from outside the rotor housing through the at least one passage opening, at least partially into the interior of the rotor housing. The cleaning strip therefore does not occupy appreciable space in the interior of the rotor housing, so that a transfer of the present invention to existing rotor housings is readily possible.

In principle, a broad spectrum of various alternatives can be used for the mounting of the cleaning strip on the rotor housing. In addition to hinge connections, however, the at least partially fixed connection of the cleaning strip to the rotor housing, for example, by rivet connections, welded connections, glued connections, etc., has proven to be advantageous in this regard. Such connections between cleaning strip and rotor housing are distinguished by high stability and comparatively simple production.

For the functioning of the cleaning strip, it is necessary for it to be at least partially movable in relation to the rotor housing upon an application of an impact or a shaking movement. The cleaning strip is therefore preferably connected to the rotor housing in an edge region, in particular a longitudinal edge region of the cleaning strip. This ensures, on the one hand, a secure connection of the cleaning strip to the rotor housing and, on the other hand, a movement freedom of the cleaning strip in relation to the rotor housing which is sufficient in practical use, in particular, in the edge region of the cleaning strip opposite to the fastening region. The longitudinal edge region of the cleaning strip is the edge region along one of the long sides of the cleaning side, i.e., one of the sides of the cleaning strip which is longer than the two sides of the cleaning strip adjoining the long side. The longitudinal edge region therefore includes in particular 25% and very particularly 20% of the total width of the cleaning strip on the part of the cleaning strip adjoining the longitudinal edge region beyond the long side of the cleaning strip. With the typical dimensions of the cleaning strip, through this type of connection, on the one hand, sufficient mounting stability is obtained and, on the other hand, the cleaning strip can be moved sufficiently in relation to the rotor housing to obtain the desired cleaning effect in the longitudinal edge region which faces away from the connection point to the rotor housing. In addition to a spot connection along the longitudinal edge region or the use of multiple connecting points located adjacent to one another in one direction, a nearly complete connection of the longitudinal edge region to the rotor housing is also possible, for example.

Although principally manifold suitable materials can be used for implementing the cleaning strip, the use of spring steel has proven to be particularly suitable. A cleaning strip consisting of spring steel allows reliable cleaning results even over very long periods of time. In addition, spring steel has a particularly high strength and simultaneously has elastic properties in a specific range.

The arrangement of the cleaning strip within the rotor housing can also vary. Depending on the soil material and/or the design of the rotor housing, sufficient cleaning results can already be obtained, for example, if the cleaning strip extends over a range of at least 50%, preferably at least 70%, in relation to the axial width of the rotor housing. However, optimum results are obtained if the cleaning strip extends over nearly the entire width of the rotor housing. This embodiment ensures that the cleaning function achieved using the cleaning strip extends over the entire width of the rotor housing.

Therefore, it has proven to be advantageous if the cleaning strip is designed as segmented, comprising, in particular, at least two cleaning strip segments arranged directly adjacent to one another along the width of the rotor housing. The width of the rotor housing is the extension of the rotor housing in the axial direction of the milling rotor, i.e., typically in the horizontal direction transversely to the working direction of the milling device. For example, typical rotor housings can have widths of >1 m, in particular, >1.5 m to >2 m. It is principally possible to provide a single continuous cleaning strip over the entire width of the rotor housing. However, multiple cleaning strip segments which are arranged adjacent to one another in the axial direction or over the width of the rotor housing, respectively, and, in order to obtain the most uniform cleaning results possible, are particularly arranged directly adjacent to one another, are simpler to install and maintain.

The cleaning strip is preferably arranged in regions of the rotor housing in which adhesions and/or contaminants frequently occur. These can be regions having angled recesses, etc., in the inner wall of the rotor housing. In general, multiple regions can therefore frequently exist in a rotor housing which tend toward the adhesion of soil material and/or contaminants. Therefore, multiple cleaning strips are also preferably arranged in a rotor housing, especially in the regions on the inner wall of the rotor housing which tend to have adhesions.

Contaminants and/or adhesions occur particularly frequently on the inner wall of the rotor housing in outlet regions of fluid into the interior of the rotor housing, specifically, for example, at fluid nozzles and/or inlet devices for foamed bitumen, etc. A generic rotor housing frequently comprises an apparatus, via which water or bitumen, in particular, foamed bitumen, can be introduced from the outside into the interior of the rotor housing. Corresponding hose connections are provided for this purpose, for example, which open in the rotor housing or to the interior of the rotor housing in a corresponding nozzle opening or a comparable outlet apparatus via which the fluid enters the interior of the rotor housing. Such fluid outlets are frequently arranged in lines adjacent to one another over the width of the rotor housing, i.e., distributed in the axial direction of the milling rotor, to allow the most uniform possible distribution of the fluid in the interior of the rotor housing. Because of the fluids used, in particular, water and/or bitumen, particularly foamed bitumen, these regions of the rotor housing are particularly susceptible to adhesions, so that the advantages of the present invention come to bear especially in this region. Such spraying devices typically have multiple fluid nozzles distributed over the width of the rotor housing, typically along a line, multiple spraying devices also being possible on or in the rotor housing, in order, for example, to be able to introduce various fluids into the working space or interior of the rotor housing simultaneously, for example. For this purpose, for example, suitable openings are arranged in the rotor housing, via which fluid can be introduced from the outside into the interior of the rotor housing and/or through which fluid nozzles can be guided into the interior of the rotor housing.

The region of the inner wall of the housing in which the fluid is sprayed via fluid nozzles into the interior of the rotor housing, or in which the fluid exits from the fluid nozzles, respectively, tends particularly strongly toward the accumulation of adhesions. However, to ensure a uniform fluid introduction over the entire work process, it is undesirable for the fluid nozzles to clog with soil material. Therefore, at least one cleaning strip is very particularly preferably arranged in the region of the fluid nozzles. If multiple regions are provided in the rotor housing in which fluid is fed into the interior of the rotor housing, each of these regions is preferably provided with a cleaning strip. In particular, multiple cleaning strips can also be arranged adjacent to one another in the rotational direction of the milling rotor or in the working direction of the milling device, in particular, in each case over the entire width of the rotor housing (in one piece or segmented).

Furthermore, the cleaning strip is preferably arranged overlapping at least one fluid outlet arranged in the rotor housing and has at least one passage recess, via which the fluid from the fluid outlet can be introduced into the interior of the rotor housing or through which the fluid outlet protrudes. Fluid outlet therefore designates a passage opening in the rotor housing through which either fluid is sprayed into the interior of the rotor housing or through which an outlet apparatus for fluid, in particular, a fluid nozzle, is guided into the interior of the rotor housing. Simultaneously, a recess is arranged not only in the rotor housing, but rather also in the cleaning strip, which at least partially and particularly completely overlaps the passage opening in the rotor housing, so as to not obstruct the fluid entry into the interior of the rotor housing through the cleaning strip. For this purpose, the passage opening in the cleaning strip is preferably implemented as congruent with the passage opening in the rotor housing. If the cleaning strip is set into motion by impacts and/or shaking movements, it moves, in particular, in direct proximity to the fluid outlet and ensures detachment of corresponding adhesions especially in this region and beyond the passage opening. In this manner, the region of the at least one fluid outlet and the surroundings adjacent thereto may be freed particularly efficiently of adhesions by the cleaning strip and/or clogs in the passage openings (in the rotor housing and/or in the cleaning strip) may be prevented or detached, respectively.

The cleaning strip is therefore particularly preferably connected to the rotor housing on its side opposite to the overlap region with the at least one fluid outlet. In this manner, it is ensured that the cleaning strip moves particularly strongly in the region of the fluid outlet upon application of an impact or shaking movement and therefore triggers a particularly efficient cleaning procedure.

Manifold different possible embodiments can be used to apply impacts and/or shaking movements to the cleaning strip. In the simplest case, for example, the at least one passage opening in the rotor housing is dimensioned sufficiently large that the impacts can be carried out manually directly from outside the rotor housing, for example, using a hammer, on the cleaning strip. Of course, multiple passage openings can also be arranged adjacent to one another, in particular, distributed over the extension of the cleaning strip in the axial direction, to be able to apply impacts as far as possible over the entire width of the cleaning strip.

For stability reasons, for example, however, it is advantageous if the at least one passage opening via which impacts and/or vibrations can be applied to the cleaning strip, can be implemented as small as possible. In this context, the use of a transmission apparatus as part of the cleaning apparatus has proven itself, via which impacts and/or oscillations applied outside the rotor housing can be transmitted to the cleaning strip in the interior of the rotor housing. In this embodiment, the impacts and/or shaking movements are therefore no longer applied directly to the cleaning strip, but rather to the transmission apparatus, which transmits the impulses induced by the impacts and/or shaking movements onto the cleaning strip. The transmission apparatus is, in particular, guided through the passage opening for this purpose.

The transmission apparatus can specifically, for example, be a bolt connected to the cleaning strip, which protrudes outward beyond the outer surface of the rotor housing. Impacts and/or shaking movements can be applied to the bolt from outside the rotor housing, which are transmitted via the bolt into the interior of the rotor housing onto the cleaning strip. In this embodiment, the transmission apparatus is therefore connected to the cleaning strip. It is obvious that multiple bolts can also be arranged on one cleaning strip.

Alternatively to arranging the transmission apparatus directly on the cleaning strip, an arrangement of the transmission apparatus on the rotor housing is also possible. For this purpose, the transmission apparatus can comprise a striker bolt mounted so it is displaceable on the rotor housing in a bolt guide, for example. The bolt guide is implemented in such a manner that the striker bolt is movable, typically linearly, between a starting position and a downstroke position, in which the striker bolt presses the cleaning strip at least partially into the interior of the rotor housing. In other words, the striker bolt is mounted so it is displaceable and can change the position and, in particular, the bending position of the cleaning strip. The bolt guide can be, for example, a guide element having a loss retainer for the striker bolt. If shaking movements and/or impacts are applied to the striker bolt, these are transmitted, guided by the striker bolt, onto the cleaning strip in the interior of the rotor housing. For this purpose, the striker bolt protrudes with a receptacle part beyond the bolt guide, comparable to the protruding bolt. It is particularly effective if the striker bolt is spring-loaded, the spring loading preferably pressing the striker bolt away from the cleaning strip into a starting position.

According to the present invention, the impacts and/or shaking movements can principally be applied manually, for example, using a hammer, a crank apparatus, etc. In a preferred embodiment, however, a drive apparatus is provided for automatically performing the cleaning function with the aid of the cleaning apparatus. The drive apparatus is therefore an element which is used to drive the impact and/or shaking movement on the cleaning strip, directly or indirectly. For this purpose, the drive apparatus can be, for example, an electric motor, a hydraulic motor, etc.

A broad spectrum of alternative embodiments can be used for the specific implementation of the drive apparatus. It is preferable if the drive apparatus comprises at least one of the elements camshaft, oscillation exciter, in particular, eccentric exciter, control unit for regulating the impact intensity and/or impact frequency, and/or a time controller. If a camshaft is used, the drive apparatus drives the revolving movement of the camshaft. The cam is used to trigger the impact and/or shaking movements and is operationally linked for this purpose, for example, directly to the cleaning strip or to a part of the transmission apparatus, for example, a striker bolt. Using the camshaft, particularly high impact frequencies can be achieved, so that continuous operation of the cleaning function in working operation of the milling rotor is even possible, for example. To trigger the cleaning vibrations of the cleaning strip, an oscillation exciter, in particular, an eccentric exciter, can additionally or alternatively be used. Such exciters are distinguished by the presence of an eccentric mass distribution, so that imbalances are obtained during rotational movements, which can be used to trigger impacts and/or shaking movements on the cleaning strip. Additionally or alternatively, a control unit can additionally be included for regulating the impact intensity and/or impact frequency of the drive apparatus. This embodiment allows optimum cleaning results to be achieved, since the impact intensity and/or the impact frequency or shaking intensity and/or shaking frequency, respectively, can be adapted especially to the adhesions occurring in the respective application. Finally, it is also possible to provide the drive apparatus with a time controller. The time controller is implemented in such a manner that the cleaning function via the cleaning strip is automatically triggered after the passage of a specific operating interval and/or a specific working distance. Overall, the embodiments having drive apparatus are therefore distinguished by particularly high operating comfort and reliable performance of the cleaning function.

Further variations of the present invention are possible, for example, with regard to the implementation of the cleaning strip. It is preferably implemented as a planar element in one plane in order to have the lowest possible space requirement in the state pressing against the inner wall of the rotor housing, although principally the use of cleaning strips having three-dimensional deformations such as, for example, bends, is also possible. The cleaning strip can also be provided as a full-surface element. In particular, for use in a rotor housing having a spray apparatus, the cleaning strip has through openings for the fluid and/or nozzle passage, however. Openings can also be provided in the cleaning strip independently of the fluid supply, in order to improve the cleaning effects, for example. The use of notches, to obtain tine-like structures, or further shape variants can also be advantageous.

Furthermore, the present invention relates to a milling device for processing soil material having a rotor housing as described in the preceding paragraphs. The basic construction of such milling devices is known. In addition to the use in a rotor housing of a milling device implemented as an add-on miller, the rotor housing according to the present invention also suggests itself for use in a self-propelled milling device, in particular, a road milling machine, a recycler, or a stabilizer.

Finally, the present invention also extends to a method for cleaning a rotor housing of soil material adhering in the interior, in particular, a rotor housing as described above. The steps "applying impacts and/or shaking movements to a cleaning strip arranged in the interior of a rotor housing" and "shaking off soil material adhering to the cleaning strip" are essential for the method according to the present invention. Through the at least partial relative mobility of the cleaning strip in relation to the rotor housing, adhesions on the cleaning strip and also in the region surrounding the cleaning strip of the interior of the rotor housing can be removed without complex removal of the milling rotor and/or lifting of the rotor housing being necessary.

It is fundamentally possible for the impacts and/or shaking movements to be applied directly to the cleaning strip. However, it is preferable if the impacts and/or shaking movements applied outside the rotor housing are transmitted with the aid of a transmission apparatus from outside the rotor housing to the cleaning strip arranged inside the rotor housing.

BRIEF DESCRIPTION OF THE DRAWINGS

The present invention will be explained in greater detail hereafter on the basis of exemplary embodiments specified in the figures. In the schematic figures.

Identical components are designated by identical reference numerals in the figures.

DETAILED DESCRIPTION OF THE INVENTION

Figure 1:
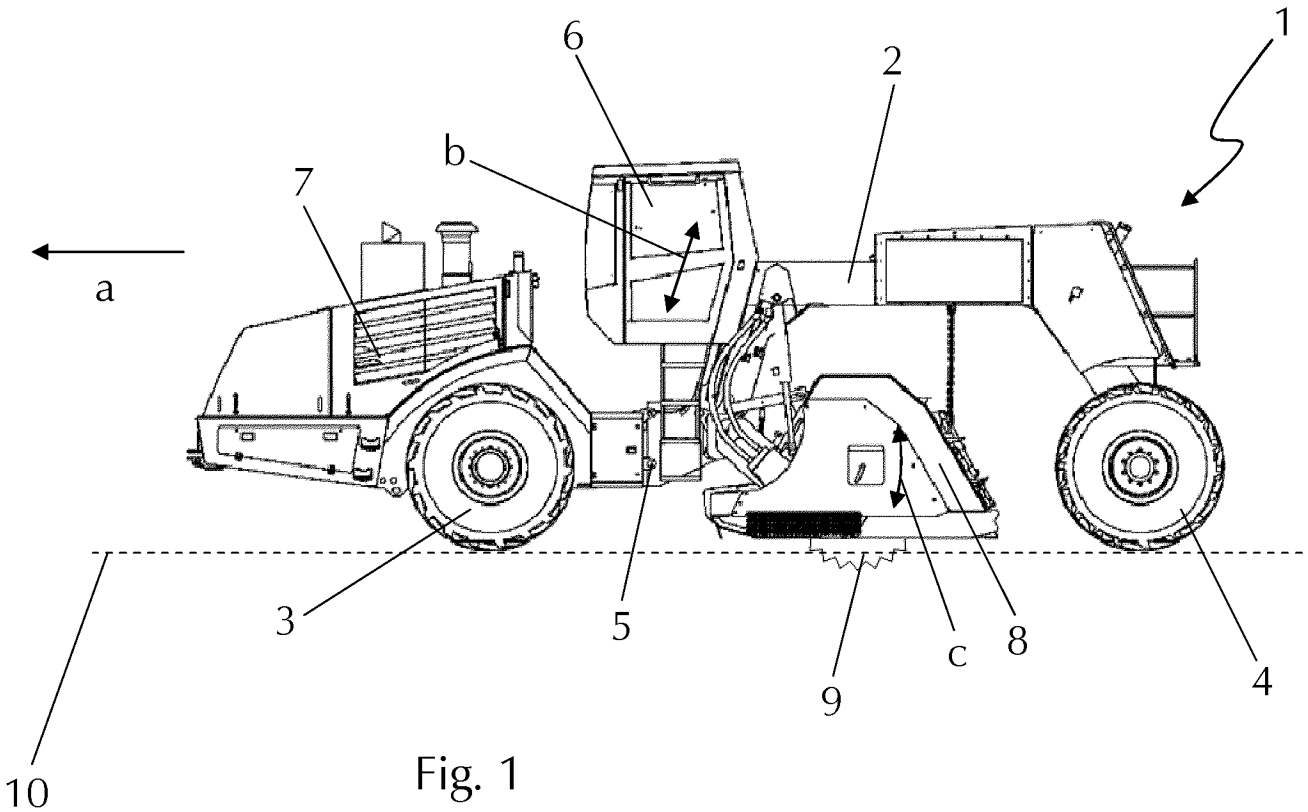
FIG. 1 shows a side view of an exemplary milling device.

FIG. 1 shows a milling device 1, specifically a so-called stabilizer or, depending on the application, a recycler or a road milling machine. The milling device comprises a machine frame 2, a front wheel pair 3, and a rear wheel pair 4, only the wheel located on the left side in the working direction A being visible in each case. The machine frame 2 is constructed in two parts, having two frame elements which are connected to one another via an articulated joint connection 5. A vertically-adjustable driver cab 6 is arranged at the height of the articulated joint connection 5. The required drive power is obtained by means of a drive device 7, which provides the drive power required both for operating the milling device 1 and also for driving the milling rotor 9 (indicated very schematically in FIG. 1). The milling device 1 is used for processing soil or roadways and has the milling rotor 9 for this purpose, which rotates around a horizontal rotational axis transversely to the working direction a. The milling rotor 9 is enclosed by a rotor housing 8 (in the present case a rotor hood), which delimits the space around the milling rotor on top and to the sides. The rotor housing 8 is implemented as open on the bottom or toward the soil 10 to be processed. The rotor housing 8 therefore encloses a working space in which the milling rotor 9 is mounted and rotates around its rotational axis 14 in working operation. The milling rotor 9 is vertically adjustable relative to the rotor housing 8 and to the machine frame 2 in the arrow direction c and has an adjustment or pivot device (not specified in greater detail) for this purpose. In the position shown in FIG. 1, the milling rotor 9 is in contact with the soil 10 to be processed. For transport purposes, the milling rotor 9 can be raised. In working operation, the milling device 1 is moved in the working direction A (forward direction) over the soil 9. Further details on the specific construction of the interior around the milling rotor 9, which is covered in a bell-like manner by the rotor housing 8, result from the further figures.

Figure 2:
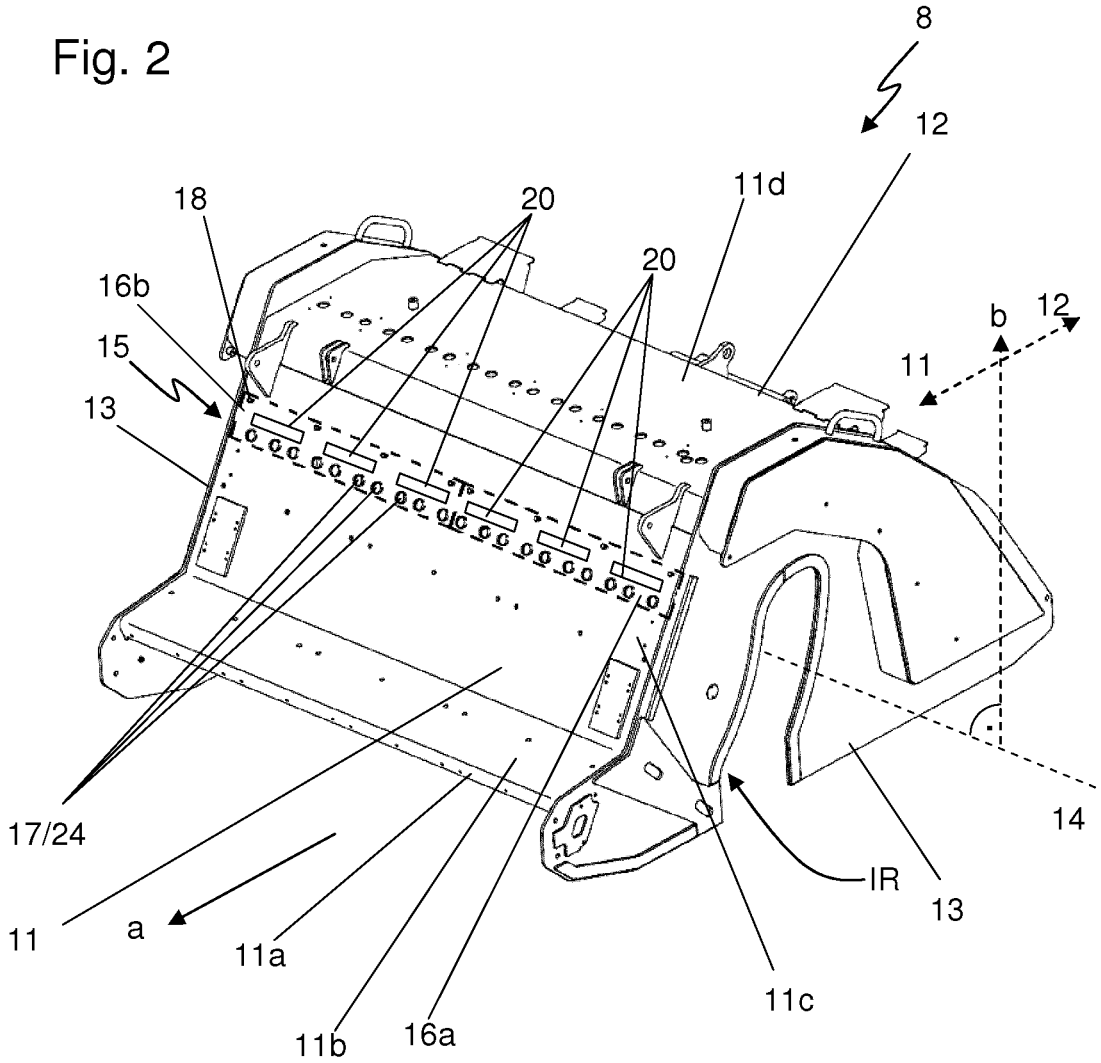
FIG. 2 shows a perspective diagonal view of the rotor housing from FIG. 1.

FIG. 2 shows the rotor housing 8 separately in a perspective diagonal view from diagonally in front. Essential elements of the rotor housing 8 are a front wall 11, a rear wall 12, and a side wall 13 on each of the sides of the rotor housing 8. The front wall 11 comprises the part of the rotor housing 8 which, in the working direction A in relation to a vertical plane along the rotational axis 14 of the milling rotor (not shown in FIG. 2), is located in front of this vertical plane (the course of the vertical plane in the vertical direction is indicated in FIG. 2 by the arrow b). Rear wall 12 accordingly designates the part of the rotor housing 8 which is located behind this vertical plane in the working direction a. FIG. 2 illustrates that neither the front wall 11, nor the rear wall 12, nor the side walls 13 must be implemented as planar wall elements. In the present rotor housing, the front wall 11 has, for example, a nearly horizontal region 11*b*, which adjoins a section 11*a* extending diagonally vertically, and the wall element 11*c*, which rises steeply diagonally to the rear, up to the nearly vertically extending wall element 11*d*, which forms the upper region of the rotor housing 8.

Figure 6:
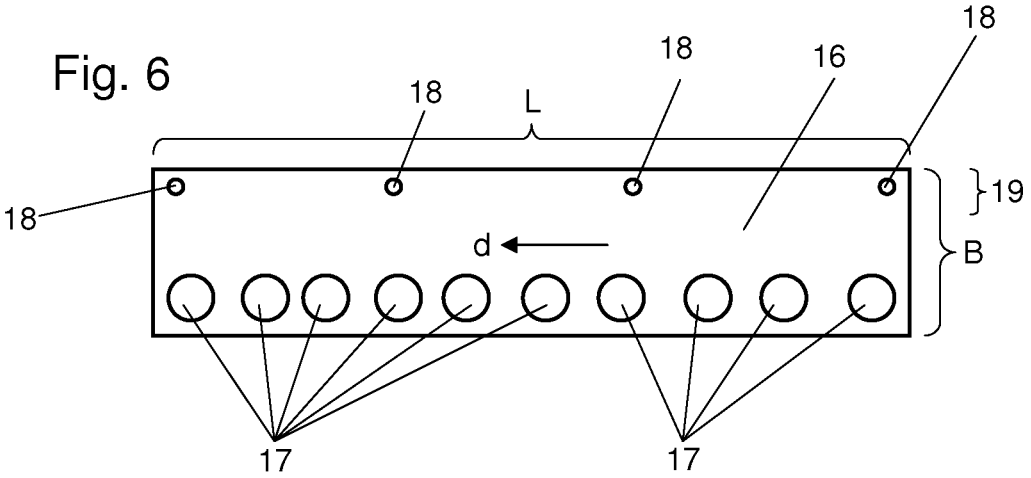
FIG. 6 shows a top view of a cleaning strip.

The rotor housing 8 comprises a cleaning apparatus 15 having a cleaning strip 16 arranged in the interior IR of the rotor housing 8. The cleaning strip 16 (shown by dashed lines in FIG. 2), which is arranged pressing flatly against the inner side of the front wall 11, is shown as a single part view in FIG. 6. The cleaning strip 16 as a whole is a planar and flat body, which has fluid passage openings 17 and fastening openings 18 in its surface. The cleaning strip 16 consists of spring steel and therefore has elastic properties in a specific range. Installation of the cleaning strip 16 in the interior of the rotor housing 8 is possible via the fastening openings 18. For this purpose, for example, screw or rivet connections are used for the connection to the rotor housing 8. Of course, it is also possible to weld the cleaning strip 16 onto the rotor housing 8. The fastening openings arranged adjacent to one another in the longitudinal direction d are arranged distributed uniformly in the longitudinal direction d in the longitudinal edge region 19 of the cleaning strip 16. In this region, the cleaning strip 16 is fixedly connected to the front wall 11 (specifically the segment 11*c*) and fixed in place in relation thereto in the installed state. On the side opposite to this longitudinal edge region 19, in which the fluid passage openings 17 are arranged, however, there is no connection of the cleaning strip 16 to the rotor housing 8. The cleaning strip 16 pressing flatly against the inner wall of the rotor housing 8 is therefore elastically movable in this region in the interior of the rotor housing 8 by bending within the elasticity range. The longitudinal edge region having the fluid passage openings 17 is therefore relatively movable in relation to the rotor housing 8. This property is utilized in the present rotor housing 8 to knock off adhesions adhering to the cleaning strip 16 and, in particular, in the region of the fluid passage openings 17 and thus to prevent clogging of the fluid passage openings 17 or to detach existing clogs. The long side of the cleaning strip 16 is indicated in FIG. 6 by L and the width is indicated by B. The long side L is distinguished in that it is substantially longer than the width B of the cleaning strip 16.

In the present exemplary embodiments, the cleaning strip 16 is also constructed as segmented in the axial direction of the rotational axis 14 or in the longitudinal direction L and comprises the two structurally-identical segments 16*a* and 16*b* arranged lying adjacent to one another (for example, according to FIG. 2). The two individual segments 16*a* and 16*b* (a single segment is shown in FIG. 6) are arranged adjoining one another and are movable separately from one another.

Figure 3:
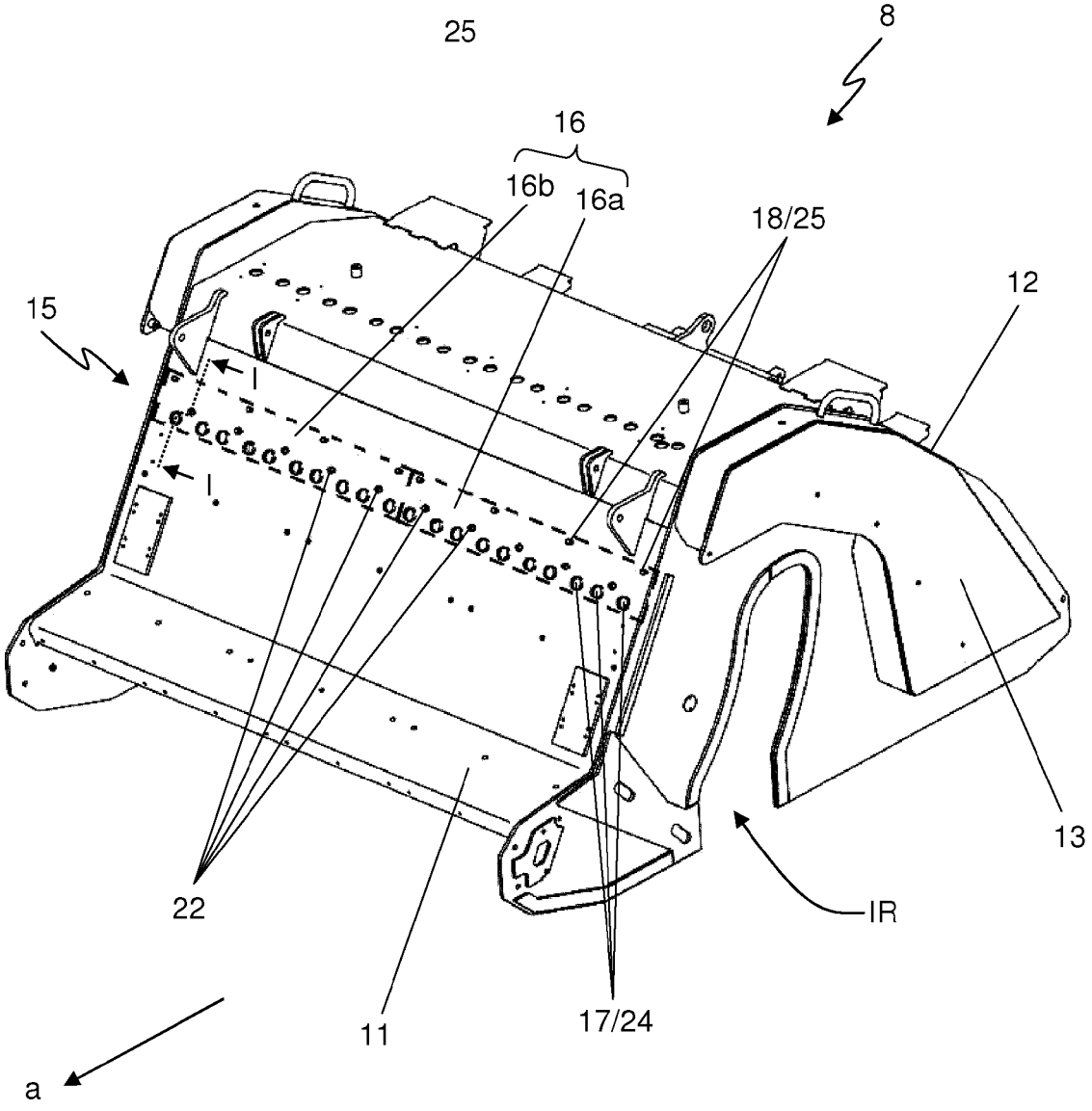
FIG. 3 shows a perspective diagonal view of an alternative embodiment of the rotor housing from FIG. 2.
Figure 4:
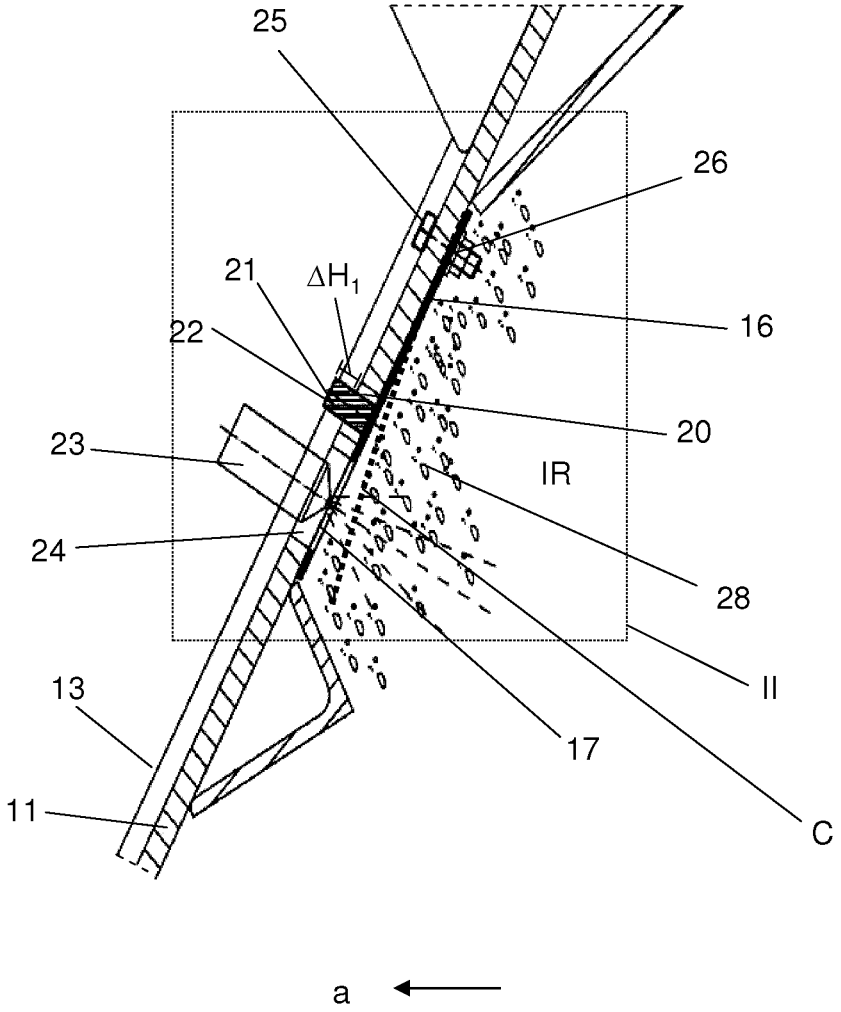
FIG. 4 shows a cross-sectional view through a subregion of the rotor housing from FIG. 3 along line I-I.
Figure 5:
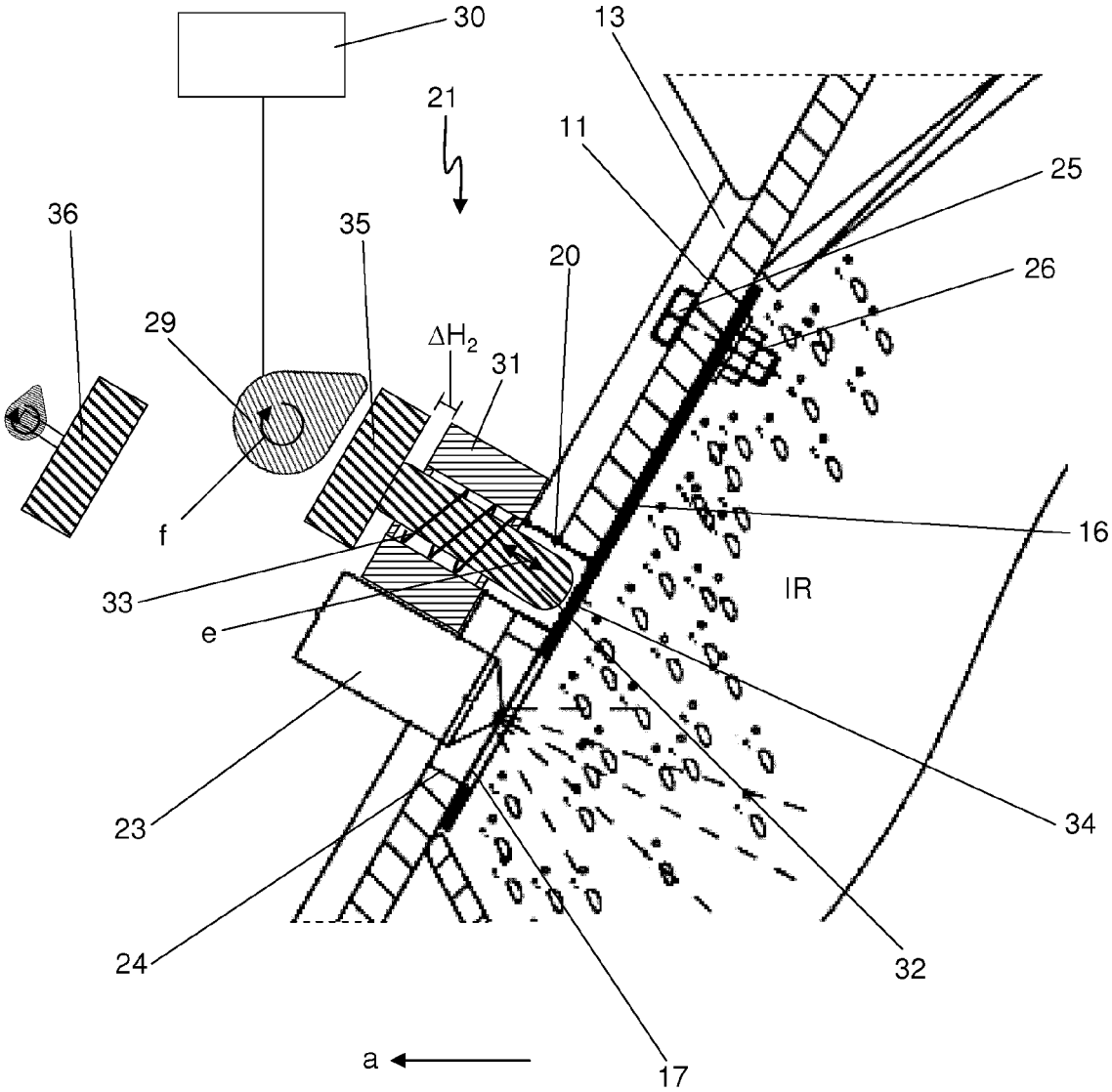
FIG. 5 shows a cross-sectional view through a detail of a rotor housing having transmission apparatus.

FIGS. 2, 3, 4, and 5 show various alternatives of how a bending movement of the cleaning strip 16 can be caused by impacts and/or shaking movements to shake off contaminants adhering to the cleaning strip 16, the exemplary embodiments indicated in the figures being understood as merely being examples and not being exhaustive. It is essential that a movement of the cleaning strip 16 from the position pressing against the inner wall of the rotor housing 8 into the interior and back can be triggered from outside the rotor housing 8 or the impacts and/or shaking movements of the cleaning strip 16 can be transmitted from outside the rotor housing 8 to the cleaning strip arranged inside the rotor housing 8. The cleaning strip 16 is arranged pressing flatly against the inner wall of the rotor housing in the present exemplary embodiments, so that the adhesions also occur, in particular, on the outer surface of the cleaning strip 16 facing toward the interior of the rotor housing 8. Furthermore, a fluid jet 27 and the soil material 28 circulated in the rotor housing 8 are indicated in FIGS. 4 and 5.

For applying impacts and/or vibrations from outside the rotor housing 8 to the cleaning strip 16, the exemplary embodiment according to FIG. 2 provides passage openings 20 in the rotor housing 8, specifically in the wall element 11*c* of the front wall 11, which is completely covered toward the interior of the rotor housing 8 by the cleaning strip 16 in the region between its two longitudinal edge regions. The passage openings 20 are therefore located, in relation to the cleaning strip 16 installed on the rotor housing 8, in a region in which the cleaning strip 16 is not fixedly connected to the rotor housing 8. The cleaning strip 16 is therefore reachable from outside the rotor housing 8 via the passage openings 20, so that, for example, manual impacts can be exerted directly on the cleaning strip 16, for example, using a hammer or a chisel, depending on the size of the passage opening 20. In this embodiment, the passage openings 20 are accordingly implemented comparatively large.

Alternatively thereto, in the exemplary embodiment according to FIGS. 3 and 4, an alternative concept for applying impacts and/or shaking movements to the cleaning strip 16 from outside the rotor housing 8 is pursued. FIG. 4 is a sectional view through the rotor housing 8 with installed cleaning strip 16 along line I-I from FIG. 3. The essential difference from the embodiment of FIG. 2 is that a transmission apparatus 21 is provided which allows the relay of impacts and/or shaking movements applied outside the rotor housing 8 to the cleaning strip 16 arranged in the interior of the rotor housing 8. The transmission apparatus specifically consists of striker bolts 22 welded onto the cleaning strip 16, which protrude pointing away from the interior of the rotor housing 8 through passage openings 20 in the rotor housing 8 outward beyond the outer surface of the rotor housing 8 (specifically the front wall 11) at the height $\Delta H_1$. The height $\Delta H_1$ is measured along an upright perpendicular on the front wall 11. The striker bolt 22 protrudes at the height $\Delta H_1$ beyond the rotor housing 8 when the cleaning strip 16 presses flatly against the inner wall of the rotor housing 8. If impacts and/or shaking movements are applied to the striker bolt 22, for example, manually using a hammer, the striker bolt 22 transmits them directly to the cleaning strip 16, so that it bends into the interior of the rotor housing 8, as also illustrated by the dashed line C in FIG. 4. This line shows the position of the cleaning strip 16 bent by impacts and/or vibrations in a transition into the interior of the milling rotor.

In particular, FIG. 4, which is a sectional view through the rotor housing 8 along line I-I from FIG. 3, also illustrates the effect of the cleaning strip 16 on the fluid inlet 24 in the rotor housing. The location of a fluid nozzle 23, which protrudes into a fluid nozzle opening 24 in the rotor housing 8 coming from outside the rotor housing 8, is shown in FIG. 4. The fluid nozzle opening 24 in the rotor housing is essentially congruent with the fluid passage opening 17 in the cleaning strip 16, so that a passage from outside the rotor housing 8 through the front wall 11 of the rotor housing 8 and through the cleaning strip 16 to the interior of the rotor housing 8 is provided. This fundamental construction is repeated for each fluid nozzle opening 24 in the cleaning strip 16, so that for each fluid nozzle opening 24, a separate and overlapping fluid passage opening 17 is provided in the cleaning strip 16 (or in the respective segment 16*a* and 16*b*, respectively). Fluid guided thereto via the fluid nozzle 23, in particular, water, foamed bitumen, and/or bitumen, can therefore be fed into the interior enclosed by the rotor housing 8 from outside the rotor housing 8. In other words, the cleaning strip 16 is implemented overlapping the region of the nozzle openings in the rotor housing 8. A movement of the cleaning strip 16 therefore also has the result that adhesions accumulated in the region of the fluid passage opening 17 and/or the fluid nozzle openings 24 in the rotor housing 8 can also be detached from outside the rotor housing by impacts and/or shaking movements on the striker bolt 22. An access to this region via the interior of the rotor housing 8 is accordingly no longer necessary. As an alternative to the rivet connection from FIG. 2, the cleaning strip 16 is fastened in the exemplary embodiment of FIGS. 3 and 4 using a screw connection, comprising a screw 25 and a nut 26 arranged inside the rotor housing 8.

Finally, FIG. 5 relates to a further variant of how impacts and/or shaking movements can be transmitted from outside the rotor housing 8 to the internal cleaning strip 16. FIG. 5 is based in its basic construction on the region of the rotor housing 8 framed by the box II in FIG. 4. The transmission apparatus 21 from FIG. 5 comprises multiple components. In addition to the components which are directly responsible for the impact and shaking transmission of the transmission apparatus 21, a camshaft 29 and a drive and control unit 30 (only indicated schematically) are provided. The transmission apparatus 21 comprises a bolt guide 31 arranged on the rotor housing 8, which is specifically a sleeve-like body connected to the front wall 11. A striker bolt 32 is mounted so it is displaceable in the longitudinal direction e in the bolt guide 31. The striker bolt 32 is spring-loaded using a compression spring 33 and is pushed by the compression spring 33 into the starting position shown in FIG. 5. In this position, the striker bolt 32 is in the position maximally pressed away from the cleaning strip 16 and can be pushed into the rotor housing 8 in the arrow direction e toward the cleaning strip 16 by the stroke $\Delta H_2$ into the rotor housing. If the striker bolt 32 is pushed in, it strikes against the cleaning strip 16 in the contact region 34 and bends the cleaning strip 16 in the edge region facing away from the screw connection 25/26 into the interior of the rotor housing 8. In contrast, if compressive force is no longer applied to the striker bolt 32 toward the rotor housing 8, the spring loading causes the striker bolt 32 to shoot back into the starting position shown in FIG. 5. Principally, a compression spring loading can also be omitted, since the elastic properties of the cleaning strip 16 are typically already sufficient for resetting the striker bolt 32 into its starting position.

A further essential aspect of the embodiment shown in FIG. 5 is that manual triggering of the impacts and/or shaking movements via the striker bolt 32 is not provided, although this is entirely possible (the elements 29 and 30 are then no longer necessary). A head element 35, which is implemented to interact with the camshaft 29, is provided on the side of the striker bolt 32 facing away from the rotor housing 8. The unit made of head element 35 and striker bolt 32 therefore forms a plunger element as a whole, whose longitudinal displacement in the arrow direction e is triggered by a rotational movement of the camshaft 29 in the rotational direction f. The cam of the camshaft 29 then slides on the head element 35 and pushes the element 32/35 toward the rotor housing 8 or toward the cleaning strip 16, respectively, so that it bends into the interior of the rotor housing 8. To drive and control the peripheral velocity of the camshaft 29, it is connected to the driving control unit 30, which provides the required drive power for the rotational drive of the camshaft 29. The working and control unit 30 is also implemented in such a manner that the peripheral velocity and therefore the impact frequency or impact strength of the element 32/35 on the cleaning strip 16 and therefore its bending frequency can be varied via the unit. Automatic performance of the cleaning function is therefore possible. Alternatively, the head element 35 and the camshaft 29 can be substituted by an eccentric exciter 36 that is as well indicated in FIG. 5. The eccentric exciter comprises a rotatable eccentric mass that leads to an oscillating movement of the striker bolt 32 when it is connected to the eccentric exciter unit.

The working and control unit 30 can also comprise a time controller, which allows the automated operation of the cleaning apparatus 15 at intervals during working operation, for example, so that at regular intervals the region of the cleaning strip 16 and, in particular, also the fluid passage opening 17 and fluid nozzle openings 24 in the rotor housing 8 are freed of adhesions.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicant's invention.

What is claimed is:

1. A rotor housing for a milling device for soil processing, comprising:

two side walls, a front wall, and a rear wall, the side walls, the front wall, and the rear wall defining an interior (IR), which is open to the ground, for receiving a milling rotor and delimiting the interior (IR) to the outside;

a cleaning apparatus having a cleaning strip, which is arranged in the interior (IR) of the rotor housing and is at least partially movable in relation to the rotor housing; and at least one passage opening in the rotor housing, via which impacts and/or shaking movements can be applied from outside the rotor housing to the cleaning strip.

2. The rotor housing according to claim 1, wherein the cleaning strip is partially fixedly connected to the rotor housing.

3. The rotor housing according to claim 1, wherein the cleaning strip is connected to the rotor housing in a longitudinal edge region of the cleaning strip.

4. The rotor housing according to claim 1, wherein the cleaning strip consists of spring steel.

5. The rotor housing according to claim 1, wherein the cleaning strip extends over nearly the entire width (B) of the rotor housing.

6. The rotor housing according to claim 1, wherein the cleaning strip is implemented as segmented, comprising at least two cleaning strip segments arranged directly adjacent to one another along the width of the rotor housing.

7. The rotor housing according to claim 1, wherein the cleaning apparatus comprises a transmission apparatus, via which impacts and/or oscillations applied outside the rotor housing are transmittable to the cleaning strip.

8. The rotor housing according to claim 7, wherein the transmission apparatus is guided through the at least one passage opening.

9. The rotor housing according to claim 7, wherein the transmission apparatus comprises a bolt, which is connected to the cleaning strip, and which protrudes outward beyond an outer surface of the rotor housing.

10. The rotor housing according to claim 7, wherein the transmission apparatus is a striker bolt, which is mounted so it is displaceable on the rotor housing in a bolt guide.

11. The rotor housing according to claim 10, wherein the striker bolt is spring-loaded.

12. The rotor housing according to claim 1, wherein a drive apparatus is provided for automatically performing the cleaning function.

13. The rotor housing according to claim 12, wherein the drive apparatus comprises at least one of the following elements:

a camshaft;

an oscillation exciter, in particular eccentric exciter;

a control unit for regulating the intensity and/or frequency of the impacts and/or the shaking movement; and/or a time controller.

14. The rotor housing according to claim 1, wherein the cleaning strip is arranged overlapping at least one fluid outlet arranged in the rotor housing, and at least one passage recess is provided in the cleaning strip for the fluid or the fluid outlet.

15. A milling device for processing soil material having a rotor housing according to claim 1.

16. The rotor housing according to claim 1, wherein the milling device comprises a road milling machine, a recycler, or a stabilizer.

17. The milling device of claim 15, wherein the milling device comprises a road milling machine, a recycler, or a stabilizer.

* * * * *